US010859061B2

(12) United States Patent
Fiala et al.

(10) Patent No.: US 10,859,061 B2
(45) Date of Patent: Dec. 8, 2020

(54) AXIAL PISTON MACHINE

(71) Applicant: Mahle International GmbH, Stuttgart (DE)

(72) Inventors: Christoph Fiala, Potsdam (DE); Michael Hoetger, Berlin (DE); Gunter Rzychon, Berlin (DE)

(73) Assignee: Mahle International GmbH

( * ) Notice: Subject to any disclaimer, the term of this patent is extended or adjusted under 35 U.S.C. 154(b) by 287 days.

(21) Appl. No.: 15/916,245

(22) Filed: Mar. 8, 2018

(65) Prior Publication Data

US 2018/0258907 A1 Sep. 13, 2018

(30) Foreign Application Priority Data

Mar. 9, 2017 (DE) ..... 10 2017 203 928

(51) Int. Cl.
*F03C 1/06* (2006.01)
*F03C 1/40* (2006.01)
(Continued)

(52) U.S. Cl.
CPC ..... *F03C 1/0628* (2013.01); *F03C 1/0678* (2013.01); *F03C 1/0681* (2013.01);
(Continued)

(58) Field of Classification Search
CPC .... F03C 1/0628; F03C 1/0678; F03C 1/0681; F04B 1/145; F04B 1/28; F04B 7/0046
(Continued)

(56) References Cited

U.S. PATENT DOCUMENTS 4,007,663 A * 2/1977 Nagatomo ..... F04B 1/2021 91/6.5
2008/0193304 A1* 8/2008 Kanai ..... F04B 27/1018 417/269

(Continued)

FOREIGN PATENT DOCUMENTS

DE 102015103743 A1 9/2016
DE 102015225292 A1 6/2017

(Continued)

OTHER PUBLICATIONS

English abstract for DE-102015225292.

*Primary Examiner* — Dominick L Plakkoottam
(74) *Attorney, Agent, or Firm* — Fishman Stewart PLLC

(57) ABSTRACT

An axial piston machine may include a housing, a guide, a shaft, at least two cylinders each delimited by an associated cylinder wall, at least two pistons, a feed configured to supply a working fluid, an exhaust configured to discharge the working fluid, and at least one actuator configured to open and close a plurality of secondary outlets. Each associated cylinder wall may include a primary outlet and a secondary outlet of the plurality of secondary outlets. Each primary outlet and each secondary outlet may be fluidically connected to an outlet chamber that is fluidically connected to the exhaust. Each primary outlet may open into an associated primary outlet channel that opens into the outlet chamber. Each secondary outlet may be fluidically connected to an associated secondary outlet channel that opens into the outlet chamber and is separate from the plurality of primary outlet channels.

20 Claims, 1 Drawing Sheet

(51) Int. Cl.
*F04B 1/28* (2006.01)
*F04B 7/00* (2006.01)
*F04B 1/145* (2020.01)

(52) U.S. Cl.
CPC ..... *F04B 1/145* (2013.01); *F04B 1/28* (2013.01); *F04B 7/0046* (2013.01)

(58) Field of Classification Search
USPC ..... 417/269, 271, 273
See application file for complete search history.

(56) References Cited

U.S. PATENT DOCUMENTS

| | | | | |
|---|---|---|---|---|
| 2008/0286125 | A1* | 11/2008 | Sugiura ..... | F04B 27/1018 417/269 |
| 2009/0297369 | A1* | 12/2009 | Mitsui ..... | F04B 27/1054 417/269 |
| 2014/0086760 | A1* | 3/2014 | Nishida ..... | F04B 27/1045 417/269 |
| 2018/0058421 | A1 | 3/2018 | Bucher et al. | |

FOREIGN PATENT DOCUMENTS

| | | | |
|---|---|---|---|
| GB | 218061 | A | 7/1924 |
| GB | 1085231 | A | 9/1967 |

* cited by examiner

AXIAL PISTON MACHINE

CROSS-REFERENCE TO RELATED APPLICATIONS

This application claims priority to German Patent Application No. DE 10 2017 203 928.0, filed on Mar. 9, 2017, the contents of which are hereby incorporated by reference in its entirety.

TECHNICAL FIELD

The present invention relates to an axial piston machine with a housing in which a plurality of cylinders are arranged, each of which accommodates a linearly displaceable piston.

BACKGROUND

Axial piston machines can be used to transport a working fluid or cause it to expand. When the working fluid is transported, the axial piston machine functions as a pump, wherein energy is applied, via a shaft of the axial piston machine for example, to propel the working fluid. When the axial piston machine is used to enable the working fluid to expand, the energy released is taken off at a shaft of the axial piston machine and can be used in many different ways. In this case, the axial piston machine functions as an expander for the working fluid and/or as a drive unit or motor.

A species-related axial piston machine configured as an axial piston motor is known from DE 10 2015 103 743 A1. The axial piston machine is furnished with a housing in which a central axial guide is embodied, the shaft of the axial piston machine being supported inside the guide. The guide is surrounded by a plurality of cylinders, each of which accommodates a linearly displaceable piston. The pistons are coupled to each other in known manner so that the stroke travel thereof causes the shaft to rotate. In order to cause the pistons to complete a stroke, working fluid is supplied to the axial piston machine via a feed and discharged from the axial piston machine via an exhaust. The working fluid is discharged from the respective cylinder via a primary outlet, which is formed in a cylinder wall of the associated cylinder. The primary outlet is freed and closed off by the stroke travel of the associated piston. A secondary outlet is also provided in the respective cylinder wall, and this also serves to enable the working fluid to be discharged from the associated cylinder, although the secondary outlets of the cylinders are opened and closed by means of an actuator which is connected non-rotatably to the shaft. The primary outlets and the secondary outlets of the respective cylinder are in fluid communication with an outlet chamber via a common outlet channel, with the result that working fluid which flows out of the primary outlet and the secondary outlet passes into the outlet chamber through the outlet channel. The outlet chamber is in fluid communication with the exhaust, so that working fluid in the outlet chamber can escape from the axial piston machine. The outlet channel is in the form of a ring channel, so that the primary outlets and the secondary outlets of all cylinders are connected to the outlet chamber via this common outlet channel. The disadvantage of this is that when the axial piston machine is operating streams of the working fluid pass between the various cylinders and/or interactions occur between the cylinders and the pistons arranged therein. This applies particularly for cylinders and pistons which are located adjacent thereto in the circumferential direction. Accordingly, one particular consequence of this is that the working fluid may overflow between individual cylinders, which can result in undesirable pressure balancing effects, pulsations and the like between the cylinders. Because of these effects, the axial piston machine operates less efficiently. In particular, this may have the effect of delaying the desired change in density of the working fluid, particularly the expansion of the working fluid.

This situation is exacerbated by the fact that the actuator is typically designed such that adjacent cylinders may overlap each other within a completed working cycle, particularly in order to allow for tolerances and the like. In the event of such an overlap, secondary outlets of two adjacent cylinders are open at the same time. As a result, the change in density of the working fluid is affected more negatively, and the efficiency of the axial piston machine is impaired further.

SUMMARY

The present invention therefore addresses the problem of describing an improved or at least alternative design for an axial piston machine of the type described in the introduction, which is in particular characterized by greater efficiency.

This problem is solved according to the invention by the object of the independent claim(s). Advantageous variants are the objects of the dependent claim(s).

The present invention is based on the general idea of connecting primary outlets and secondary outlets of an axial piston machine to an outlet chamber in fluidically separate manner to enable the working fluid to be discharged from the axial piston machine. This has the effect of considerably reducing the interaction or reciprocation between the primary outlet and the secondary outlet of a cylinder of the axial piston machine. By this means, even the primary outlets of different cylinders are connected to the outlet chamber in fluidically separate manner, so that the fluidic or stream-related reciprocation between different cylinders is reduced further. Consequently, the variations from the desired pressure conditions in the working fluid are smaller in the respective cylinder. In particular, pulsations and the like are then also prevented or at least reduced, and/or the induced medium pressure is raised. As a result, the efficiency of the axial piston machine is increased. In keeping with the inventive thought, the axial piston machine has a housing in which a guide is formed, wherein a shaft of the axial piston machine is supported in the guide. The axial piston machine includes at least two such cylinders which are formed in the housing, wherein a piston is arranged in stroke-displaceable manner inside the respective cylinder. The axial piston machine further has a feed for introducing the working fluid into the axial piston machine and an exhaust for discharging the working fluid from the axial piston machine. The respective cylinder is delimited by an associated cylinder wall, wherein at least one such primary outlet to allow working fluid to escape from the associated cylinder and one such secondary outlet separate from the at least one primary outlet to allow working fluid to escape from the associated cylinder are provided, particularly conformed in the respective cylinder wall. The primary outlets and the secondary outlets communicate fluidically with the outlet chamber, wherein the outlet chamber communicates fluidically with the exhaust to enable working fluid to escape from the housing. The axial piston machine is further equipped with at least one actuator, wherein each of the secondary outlets are freed or closed off with the at least one actuator. It is provided according to the invention that the respective primary outlet opens into an associated primary outlet channel, wherein the primary outlet channels are conformed separately and each open into the outlet chamber. In this way, working fluid flowing out of the respective primary outlet may be transported separately to the outlet chamber. Moreover, the secondary outlets are also connected fluidically to a secondary outlet channel, wherein the respective secondary outlet channel is conformed separately from the primary outlet channels and opens into the outlet chamber. Consequently, the primary outlet channels are routed to the outlet chamber separately from the respective secondary outlet channel.

In this context, the separate configuration of the channels means that they are fluidically separate and/or positioned at a distance within their route from the associated outlet as far as the outlet chamber.

In principle, the primary outlets may be closed and opened in any way. The primary outlets are preferably closed off and freed by the stroke travel of the associated piston during operation of the axial piston machine.

In principle, the respective outlet in the cylinder wall may be of any shape. Preferred are embodiments in which the respective outlet is formed in the region of the cylinder wall which radially delimits the cylinder. The separate conformation of the respective primary outlet from the secondary outlet of the same cylinder is advantageously achieved by constructing the primary outlet at a distance from the secondary outlet. In particular, the secondary outlet is arranged with an axial separation or offset relative to the at least one primary outlet. In order to allow the working fluid to pass into the respective cylinder, advantageously at least one cylinder inlet is provided in each cylinder. The cylinder inlet of the respective cylinder is preferably arranged on the axial end of the cylinder. In this context, it is preferable if the secondary outlet is arranged with an axial offset towards the associated cylinder inlet relative to the at least one primary outlet of the same cylinder.

Embodiments in which the axial piston machine has at least three such cylinders, each having an associated piston are preferred. This enables the axial piston machine to operate more simply.

The pistons of the axial piston machine are expediently connected to each other in such manner that when the axial piston machine is operating they cause the shaft to rotate or are driven by a rotation of the shaft. This may be achieved for example with the aid of a swash plate or a wobble plate, wherein the pistons are connected to the plate mechanically and the shaft is attached to the plate non-rotatably.

Embodiments are preferred in which two or more such primary outlets are arranged on at least one of the cylinder walls, and each communicates fluidically with the outlet chamber via an associated primary outlet channel of such kind. This means that the primary outlet channels of the primary outlets of the same cylinder are also separate from each other. The provision of at least two primary outlets of such kind results in an enlarged total flow cross section for the working fluid, so that for example a correspondingly greater degree of expansion of the working fluid can be effected. In particular, the greater degree of expansion results in greater efficiency of the axial piston machine. Moreover, the separate conformation of the primary outlet channels has the effect of reducing interaction of the working fluid flowing through the corresponding primary outlets or primary outlet channels, thus serving to increase the efficiency of the axial piston machine in this way also.

Variants in which at least two of the primary outlets are arranged on radially opposite sides of the cylinder wall relative to the associated cylinder have proven advantageous. In this arrangement, the primary outlets may be arranged diametrically opposite each other, in particularly on the same level axially. Such an arrangement of the primary outlets in the cylinder wall results in a more even flow of the working fluid through the primary outlets. In this way, an improved degree of expansion of the working fluid is achieved for example and consequently improved efficiency. Moreover, misalignment due to the flow is reduced and/or inclination of the associated piston due to the flow is reduced, which in turn results in lower friction losses and the like and an increase in the efficiency of the axial piston machine.

Alternatively or additionally thereto, it is possible to provide two or more secondary outlets of such kind in at least one of the cylinder walls. In this way, an enlarged total flow cross section is created for the working fluid. Consequently, a greater degree of expansion of the working fluid is achieved, resulting particularly in increased efficiency of the axial piston machine.

It is further possible to arrange at least two of the secondary outlets in the cylinder wall radially opposite each other, particularly diametrically opposite each other with reference to the associated cylinder. Such an arrangement results in a more even flow of the working fluid through the secondary outlets. This results particularly in an improved degree of expansion of the working fluid and thus also improved efficiency of the axial piston machine.

As a further consequence, misalignment due to the flow is reduced and/or inclination of the associated piston due to the flow is reduced, which in turn results in lower friction losses and the like, thereby increasing the efficiency of the axial piston machine.

In principle, a separate secondary outlet channel of such kind which connects the secondary outlet fluidically with the outlet chamber may also be provided for the respective secondary outlet. This results in a reduced interaction between the working fluid flowing through the corresponding secondary outlets and the secondary outlet channels, thus serving to increase the efficiency of the axial piston machine.

Variants in which at least two secondary outlets of such kind communicate fluidically with the outlet chamber via a common secondary outlet channel of such kind are also conceivable. The secondary outlets are preferably immediately adjacent secondary outlets in the circumferential direction of the shaft. In this context, they may be secondary outlets of different cylinders, particularly cylinders that are adjacent in the circumferential direction. Because of the operating principle of the axial piston machine, particularly the working cycle of the respective piston, the use of a common secondary outlet channel of such kind results in little or no interactions between the working fluid flowing out of the various secondary outlets. Consequently, such an interaction remains low, and the manufacture of the axial piston machine is made easier by the use of such a common secondary outlet channel.

In this context, embodiments are advantageous in which the at least one actuator is designed such that when the axial piston machine is in operation the actuator only frees the secondary channels connected to the outlet chamber via a common secondary outlet channel of such kind one after the other. This reduces the reciprocation of these secondary outlets further and further increases the efficiency of the axial piston machine.

It may also be provided that the at least one actuator is configured in such manner that it does not open more than two such secondary outlets and/or secondary outlet channels per cylinder at the same time.

Embodiments in which the outlet chamber is located as far as possible, particularly at a maximum distance from at least one of the primary outlets, preferably from all primary outlets, and/or from at least one of the secondary outlets, preferably from all secondary outlets, are to be considered advantageous. The result of this is that the interaction of the working fluid flowing through the primary outlets and/or the secondary outlets is reduced. The effect of this is to increase the efficiency of the axial piston machine. In this context, the maximum distance refers particularly to the flow path between the at least one primary outlet and the outlet chamber, and/or between the at least one secondary outlet and the outlet chamber. Accordingly, the maximum distance may be achieved by maximising the distance between the outlet chamber and the at least one primary outlet channel and/or the at least one secondary outlet. In particular, the outlet chamber may be arranged in an axial end region, for example in the axial end region of the housing farthest from, or opposite, the respective cylinder inlet. Alternatively or additionally thereto, the respective associated primary outlet channel and/or secondary outlet channel may be routed in such manner as to bring about an enlargement of the flow path. Such routing may include curves and/or sections of the primary outlet channel and/or secondary outlet channel which incline towards each other and/or run transversely to each other.

In order to reduce the interaction of the working fluid as it flows through the various secondary outlets, it is conceivable to assign at least two of the secondary outlets to one such associated actuator in each case. Thus, two actuators may be present, each of which frees and closes different secondary outlets.

In an advantageous variant, outer openings of at least two such secondary outlets located farthest from the associated cylinder are offset with respect to each other, and the at least one actuator is adapted to this offset arrangement in such manner that during operation it frees and closes the associated secondary outlets individually, particularly independently of each other. In this way, the interaction of the working fluid flowing through the corresponding secondary outlets is at least reduced, and the efficiency of the axial piston machine correspondingly increased. In this context, the secondary outlets may belong to different, particularly adjacent cylinders.

An offset arrangement of such kind is advantageously created by offsetting the outer openings of the secondary outlets axially with respect to each other, wherein "axially" refers to the shaft and the cylinders. The axially offset arrangement makes it possible to provide freeing means, for example freeing sections, cutaways or the like on an associated common actuator corresponding to the offset arrangement of the outer openings, so that only one such actuator is used to free and close said secondary outlets. For example, a freeing section on the actuator may be assigned to the respective outer opening, by which the associated secondary outlet is freed. In this context, the freeing sections are offset axially, corresponding to the axially offset arrangement of the outer openings. This means that the freeing sections of the actuator and the axially offset arrangement of the outer openings are aligned with each other in such manner that when the respective freeing section overlaps the associated outer opening radially and axially, the working fluid is able to flow through the associated secondary outlet. As a result, separation of the freeing of the respective secondary outlets is improved, thereby reducing reciprocation between the corresponding streams. It also makes a more compact construction of the axial piston machine possible, in particular the actuator may be constructed with a smaller radius.

Variants are also conceivable in which the outer openings are offset in the circumferential direction. These outer openings are preferably also offset axially and/or the associated secondary outlets are freed and closed by different actuators.

An improved variant of the axial piston machine may be realised if the route of at least one secondary outlet of such kind through the associated cylinder wall is inclined. The inclined route is created when the secondary outlet, particularly a longitudinal axis of the secondary outlet, forms an angle which is not equal to 90°, particularly an acute angle, with the axial direction of the shaft and/or the associated cylinder. This creates a longer path through the secondary outlet and/or a larger sealing surface with the at least one actuator, so that improved sealing of the at least one secondary outlet is possible in the closed position. Accordingly, pressure losses are reduced, which in turn helps to increase the efficiency of the axial piston machine.

In principle the respective primary outlet channel and/or secondary outlet channel may follow any route. Embodiments in which at least one primary outlet channel and/or secondary outlet channel of such kind, preferably all channels are routed substantially axially, i.e. parallel to the shaft, are preferable.

Embodiments in which the primary outlet channels and/or the respective secondary outlet channel extend(s) substantially axially parallel to the shaft are preferable. This particularly serves to simplify the production of the axial piston machine. It also contributes to a reduction in transmission losses, which in turn serves to increase the efficiency of the axial piston machine.

Embodiments are also preferable in which the cylinders surround the guide equidistantly. The same applies for secondary outlet channels, which surround the guide equidistantly if they are present.

It is advantageous if at least one secondary outlet channel of such kind is arranged radially more closely to the shaft than the primary outlet channels. In this way in particular it is possible to fasten the at least one actuator non-rotatably to the shaft and/or in the guide.

Embodiments in which at least one such secondary outlet opens into the guide and at least one such secondary outlet channel communicates fluidically with the guide via a guide outlet have been found to be advantageous. The at least one actuator is also advantageously designed in such manner that at the same time as freeing the secondary outlet it also connects the secondary outlet to the guide outlet. In this way, the at least one actuator may be provided in the guide and the construction of the axial piston machine may be more compact. It is further possible for at least one actuator to be coupled directly to the shaft, thereby enabling a simpler and/or more compact construction of the axial piston machine.

In principle, the respective actuator may be of any design. The respective actuator may be for example a roller slide which is connected non-rotatably to the shaft. A cam may also be used as the actuator. It is also conceivable to utilise a valve as the actuator or freeing means. Of course, different actuators may also be used.

Said freeing means may be cutaways in the actuator, particularly in the roller slide.

In principle, the housing may include a hollow space in which the channels and/or the guide are arranged, in the form of tubular bodies, for example.

Embodiments in which the housing is of solid construction are preferred, wherein the outlets and/or the channels and/or the cylinders are formed in the housing, particularly by milling, drilling or the like. This means that the guide and/or the respective channel and/or the respective cylinder may be a drillhole in the housing.

Further important features and advantages of the invention will become apparent from the subordinate claims, the drawing and the associated description of the figures with reference to the drawing.

Of course, the features described in the preceding text and those which will be explained subsequently are usable not only in each of the combinations described, but also in other combinations are alone without departing from the scope of the present invention.

Preferred embodiments of the invention are represented in the drawing and will be explained in greater detail in the following description, wherein the same reference signs refer to identical or similar or functionally equivalent components.

DETAILED DESCRIPTION

Figure 1:
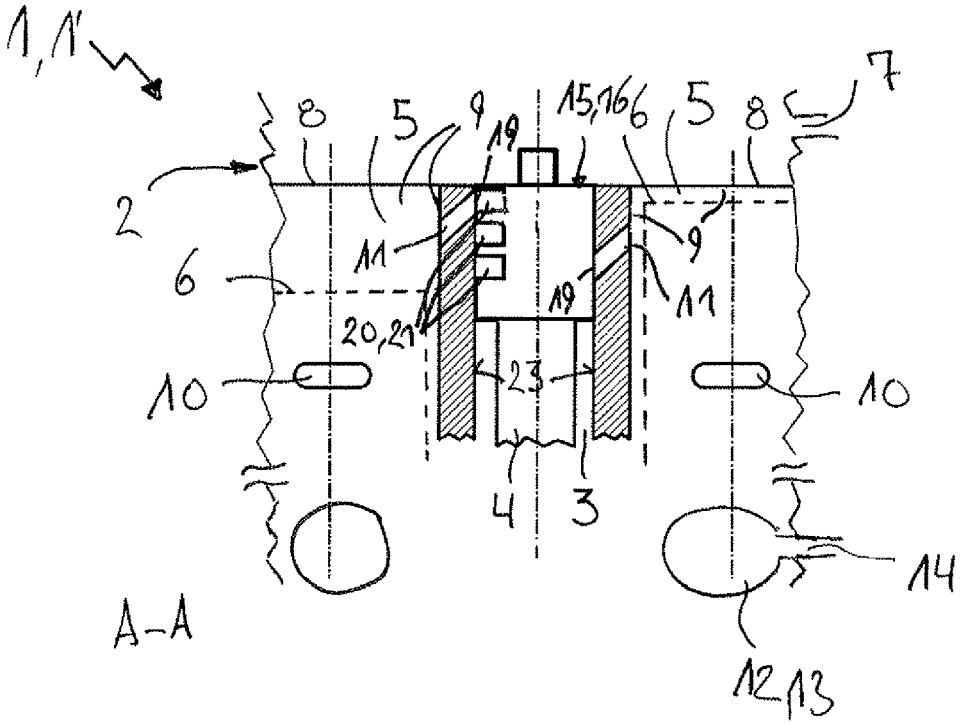
FIG. 1 is an axially cutaway and partial view of an axial piston machine.

An axial piston machine 1, as illustrated in FIG. 1, has a housing 2, which may be of solid construction. Inside housing 2, an axially extending guide 3 is formed, in which a shaft 4 of axial piston machine 1 is guided in rotatable manner. A plurality of cylinders 5 is also conformed inside housing 2, of which two are shown in FIG. 1. An associated piston 6 is arranged in stroke-displaceable manner inside the respective cylinder 5, pistons 6 being represented as transparent and by dashed lines in FIG. 1. During operation of the axial piston machine 1, in the form of an axial piston motor 1' in the example shown, a working fluid is supplied to axial piston machine 1 via a feed 7, which fluid is introduced into the associated cylinder 5 by a control member—not shown—for example a hub attached non-rotatably to shaft 4, via an associated cylinder inlet 8 of said cylinder 5. This causes pistons 6 to execute a stroke, which pistons are coupled to each other by suitable means, for example a swash plate—not shown—in such manner that shaft 4 is caused to rotate. The respective cylinder 5 is delimited in the circumferential direction, that is to say radially by a cylinder wall 9, which forms an outer shell of cylinder 5. At least one primary outlet 10 and a secondary outlet 11 which is separate and positioned at a distance from primary outlet 10 are formed in the respective cylinder wall 9, wherein primary outlets 10 and secondary outlets 11 function in known manner to discharge the working fluid from the associated cylinder 5. The respective primary outlet 10 and the respective secondary outlet 11 communicate fluidically with an outlet chamber 12, which may be embodied as a ring chamber 13 and communicates fluidically with an exhaust 14 of axial piston machine 1 to transport or discharge the working fluid out of axial piston machine 1. Outlet chamber 12 is located with axial separation from cylinder inlets 8, particularly on the axially opposite side, and thus in an axially terminal region. Axial piston machine 1 is also equipped with at least one actuator 15, with which the respective secondary outlet 11 may be opened and closed. In the example shown, a single such actuator 15 is provided, and is embodied as a roller slide 16 which is seated in guide 3 and connected non-rotatably to shaft 4. As may be seen in FIG. 1, the respective primary outlet 10 is positioned axially farther away from the associated cylinder inlet 8 than is the secondary outlet 11 of the associated cylinder 5.

Figure 2:
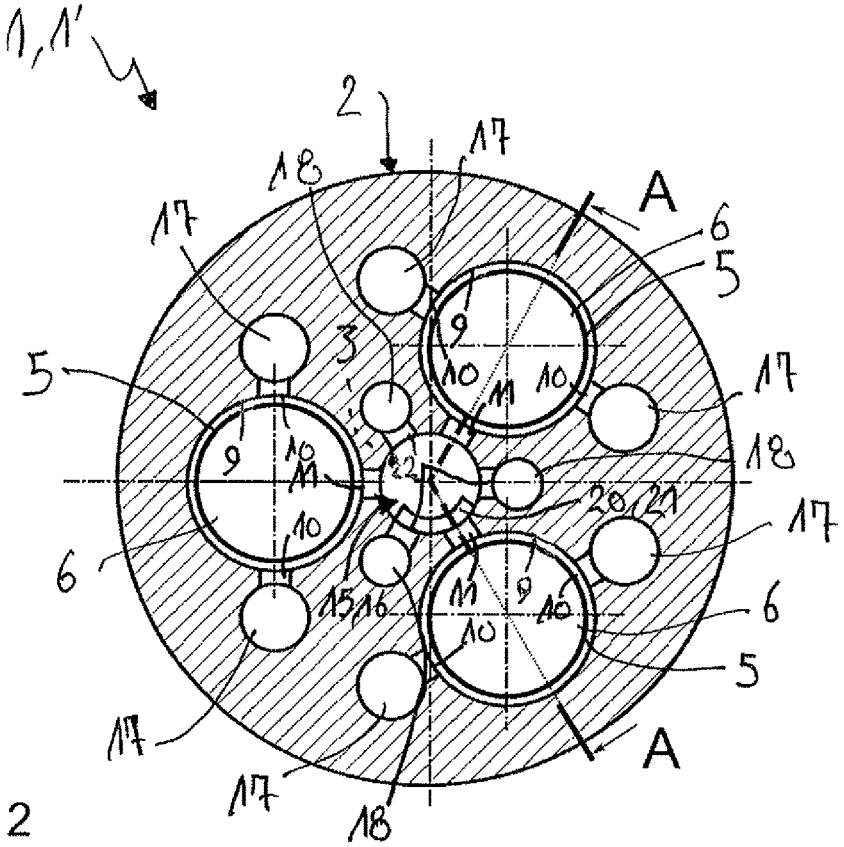
FIG. 2 shows a graduated cross section through the axial piston machine.

FIG. 2 shows a graduated cross section through axial piston machine 1, wherein the cross section is illustrated incrementally in such manner that primary outlets 10 and secondary outlets 11 of the respective cylinder 5 are visible. The cross section through axial piston machine 1 indicated by A-A in FIG. 2 is illustrated in FIG. 1. FIG. 2 shows that axial piston machine 1 in the example show has three such cylinders 5 and three such pistons 6. It also shows that guide 3 and therewith also shaft 4 and cylinders 5 are aligned axially parallel, wherein cylinders 5 surround guide 3 equidistantly.

As is also evident in FIG. 2, the respective primary outlet 10 opens into a n associated primary outlet channel 17, wherein primary outlet channel 17 are fluidically unconnected and located at a distance from each other, and are accordingly separate structures. Primary outlet channels 17 each open into outlet chamber 12. Thus, the working fluid flowing through respective primary outlet 10 is able to pass through an associated primary outlet channel 17 of such kind and into outlet chamber 12 separately from the other primary outlets 10 and the secondary outlets 11. Additionally, secondary outlets 11 each communicate fluidically with a secondary outlet channel 18, wherein the respective secondary outlet channel 18 is fluidically disconnected and positioned at a distance from the primary outlet channels 17, and is thus constructed separately and opens into outlet chamber 12. In this way, the working fluid flowing through the respective secondary outlet 11 may pass into outlet chamber 12 in particular separately from the working fluid flowing through the respective primary outlet 10. In this context, it is conceivable in principle that two secondary outlets 11 of such kind may have a common secondary outlet channel 18 of such kind. In the example shown, an associated secondary outlet channel 18 is assigned to the respective secondary outlet 11. It is also evident that outlet channels 17, 18 are aligned axially parallel to cylinders 5 and guide 3. The secondary outlet channels 18 surround guide 3 equidistantly. The primary outlet channels 17 also surround guide 3 equidistantly, wherein the secondary outlet channels 18 are arranged radially closer to guide 3 than cylinders 5 and primary outlet channels 17.

FIG. 2 further shows that two primary outlets 10 of such kind are formed in the respective cylinder wall 9 of the respective cylinder 5, and each communicates fluidically with outlet chamber 12 via an associated primary outlet channel 17 of such kind, wherein primary outlets 11 of the respective cylinder 5 are arranged radially opposite each other in cylinder wall 9.

As shown in FIG. 1, the outer openings 19 of secondary outlets 11 farthest from the associated cylinder 5 may be offset axially relative to each other. In this context, actuator 15 is furnished with respectively associated freeing sections 20, wherein in the example shown the respective freeing section 20 is embodies as a cutaway 21 in actuator 15 which extends over a limited section in the circumferential direction of actuator 15. Freeing sections 20 are thus offset axially, correspondingly to the axially offset arrangement of outer openings 19, so that besides a radial overlap an axial overlap must also occur between the respective freeing section 20 and the associated outer opening 19 in order to free the associated secondary outlet 11.

As is shown in FIGS. 1 and 2, secondary outlets 11 may each open into guide 3, wherein at least one secondary outlet channel 18 of such kind communicates fluidically with guide 3 via a guide outlet 22, which is formed in a guide wall 23 that delimits guide 3, and wherein actuator 15 connects this secondary outlet 11 fluidically to guide outlet 22 when said secondary outlet 11 is freed. In the example shown, such a guide outlet 22 is assigned to the respective secondary outlet 11 and respective secondary outlet channel 18. The fluidic connection between the respective secondary outlet 11 and the associated guide outlet 22 is then created by freeing section 20 and cutaway 21 in actuator 15.

As is illustrated in FIG. 1, the respective secondary outlet 11 passes through the associated cylinder wall 9 at an angle and forms an angle which is not equal to 90°, in particular an acute angle, with the axial direction of shaft 4 and of the associated cylinder 5.

In the example shown, primary outlets 10 extend perpendicularly, that is to say radially relative to the axial direction of guide 3 and shaft 4 and of the associated cylinders 5. Guide outlets 22 also extend radially relative to the axial direction of guide 3 and shaft 4.

Channels 17, 18 and cylinders 5 may be created in the solid housing 2 in an appropriate material removing machining process. In particular, channels 17, 18, guide 3 and cylinders 5 may each be drilled into housing 2. The respective primary outlet 10 and/or the respective secondary outlet 11 may also be drilled into the solid housing 2.

The structural arrangements of axial piston machine 1 result in a structural decoupling of the streams of working fluid exiting each of the respective cylinders 5, and decoupling of the cylinders 5 from each other. Consequently, reciprocations between the individual cylinders 5 are reduced, in particular the medium pressure is increased. This serves to increase the efficiency of axial piston machine 1.

The invention claimed is:

1. An axial piston machine comprising:

a housing;

a guide disposed within the housing;

a shaft arranged within the guide and configured to be guided therein;

at least two cylinders disposed within the housing, each cylinder of the at least two cylinders delimited by an associated cylinder wall;

at least two pistons, each piston of the at least two pistons arranged within an associated cylinder of the at least two cylinders in a stroke-displaceable manner;

a feed configured to supply a working fluid;

an exhaust configured to discharge the working fluid;

at least one actuator configured to open and close a plurality of secondary outlets;

wherein the associated cylinder wall of the at least two cylinders includes a primary outlet of a plurality of primary outlets, the primary outlet configured to discharge the working fluid from the associated cylinder;

wherein the associated cylinder wall of the at least two cylinders further includes a secondary outlet of the plurality of secondary outlets separate from the primary outlet and configured to discharge the working fluid from the associated cylinder;

wherein the plurality of primary outlets and the plurality of secondary outlets are fluidically connected to an outlet chamber disposed within the housing, and the outlet chamber is fluidically connected to the exhaust;

wherein each primary outlet of the plurality of primary outlets opens into an associated primary outlet channel of a plurality of primary outlet channels, and the plurality of primary outlet channels open into the outlet chamber; and wherein each secondary outlet of the plurality of secondary outlets is fluidically connected to an associated secondary outlet channel of a plurality of secondary outlet channels, and the plurality of secondary outlet channels open into the outlet chamber and are separate from the plurality of primary outlet channels.

2. The axial piston machine according to claim 1, wherein the associated cylinder wall of at least one cylinder of the at least two cylinders includes at least two primary outlets of the plurality of primary outlets.

3. The axial piston machine according to claim 2, wherein the at least two primary outlets of the associated cylinder wall of the at least one cylinder are disposed therein radially opposite each other.

4. The axial piston machine according to claim 1, where at least two secondary outlets of the plurality of secondary outlets communicate fluidically with the outlet chamber via a common secondary outlet channel.

5. The axial piston machine according to claim 1, wherein the at least one actuator is configured to only open the secondary outlet of a cylinder of the at least two cylinders one after the other.

6. The axial piston machine according to claim 1, wherein:

each secondary outlet of the plurality of secondary outlets includes an outer opening facilitating the connection between the secondary outlet and the secondary outlet channel, and the outer opening of adjacent cylinders of the at least two cylinders are offset from one another; and the at least one actuator is configured such that each secondary outlet is openable and closable independently.

7. The axial piston machine according to claim 6, wherein:

the outer opening of adjacent cylinders of the at least two cylinders are offset axially from one another with respect to a longitudinal axis of the shaft; and the at least one actuator includes a plurality of freeing sections, each freeing section of the plurality of freeing sections configured to open an associated outer opening, and the plurality of freeing sections are offset axially to correspond with the outer openings.

8. The axial piston machine according to claim 1, wherein at least one secondary outlet of the plurality of secondary outlets is disposed within the associated cylinder wall at an angle.

9. The axial piston machine according to claim 1, at least one of i) the plurality of primary outlet channels and ii) the plurality of secondary outlet channels extend axially parallel to the shaft.

10. The axial piston machine according to claim 1, wherein at least one secondary outlet of the plurality of secondary outlets opens into the guide, and at least one secondary outlet channel of the plurality of secondary outlet channels communicates fluidically with the guide via a guide outlet, and wherein the at least one actuator is configured to connect each secondary outlet of the plurality of secondary outlets fluidically with the guide outlet when each secondary outlet is open.

11. The axial piston machine according to claim 1, wherein the outlet chamber is arranged in an axial end region of the housing.

12. The axial piston machine according to claim 1, wherein each cylinder of the at least two cylinders is radially delimited by the associated cylinder wall.

13. The axial piston machine according to claim 1, wherein:

the plurality of primary outlet channels and the plurality of secondary outlet channels extend within the housing axially parallel to the at least two cylinders; and the plurality of primary outlets and the plurality of secondary outlets extend transversely to the plurality of primary outlet channels and the plurality of secondary outlet channels, respectively.

14. The axial piston machine according to claim 1, wherein, relative to the shaft, the plurality of secondary outlet channels are disposed radially closer to the shaft than the plurality of primary outlet channels and the at least two cylinders.

15. An axial piston machine comprising:

a housing including a guide disposed within the housing;

a shaft arranged within the guide and configured to be guided therein;

at least two cylinders disposed within the housing, each cylinder of the at least two cylinders delimited by an associated cylinder wall;

at least two pistons, each piston of the at least two pistons arranged within an associated cylinder of the at least two cylinders in a stroke-displaceable manner;

a feed configured to supply a working fluid;

an exhaust configured to discharge the working fluid;

at least one actuator configured to open and close a plurality of secondary outlets one after the other;

wherein each associated cylinder wall includes a primary outlet of a plurality of primary outlets configured to discharge the working fluid from the associated cylinder;

wherein each associated cylinder wall further includes a secondary outlet of the plurality of secondary outlets separate from the primary outlet and configured to discharge the working fluid from the associated cylinder, the plurality of secondary outlets opening into the guide;

wherein the plurality of primary outlets and the plurality of secondary outlets are fluidically connected to an outlet chamber disposed within the housing, and the outlet chamber is fluidically connected to the exhaust;

wherein each primary outlet of the plurality of primary outlets opens into an associated primary outlet channel of a plurality of primary outlet channels, and the plurality of primary outlet channels open into the outlet chamber; and wherein each secondary outlet of the plurality of secondary outlets is fluidically connected to an associated secondary outlet channel of a plurality of secondary outlet channels that are separate from the plurality of primary outlet channels, and the plurality of secondary outlet channels fluidically communicate with i) the guide via a guide outlet and ii) the outlet chamber.

16. The axial piston machine according to claim 15, wherein:

each secondary outlet of the plurality of secondary outlets includes an outer opening facilitating the connection between the secondary outlet and the guide, and the outer opening of adjacent cylinders of the at least two cylinders are offset from one another;

the at least one actuator is configured such that each secondary outlet is openable and closable independently;

the outer opening of adjacent cylinders of the at least two cylinders are offset axially from one another with respect to a longitudinal axis of the shaft; and the at least one actuator includes a plurality of freeing sections, each freeing section of the plurality of freeing sections is configured to open an associated outer opening, and the plurality of freeing sections are offset axially to correspond with the outer openings.

17. An axial piston machine comprising:

a housing including a guide disposed within the housing;

a shaft arranged within the guide and configured to be guided therein;

at least two cylinders disposed within the housing, each cylinder of the at least two cylinders delimited by an associated cylinder wall;

at least two pistons, each piston of the at least two pistons arranged within an associated cylinder of the at least two cylinders in a stroke-displaceable manner;

a feed configured to supply a working fluid;

an exhaust configured to discharge the working fluid;

at least one actuator configured to open and close a plurality of secondary outlets independently of one another;

wherein each associated cylinder wall includes a primary outlet of a plurality of primary outlets, the primary outlet configured to discharge the working fluid from the associated cylinder;

wherein each associated cylinder wall further includes a secondary outlet of the plurality of secondary outlets separate from the primary outlet and configured to discharge the working fluid from the associated cylinder, each secondary outlet of the plurality of secondary outlets including an outer opening facilitating a connection between the secondary outlet and the guide, the outer opening of adjacent cylinders of the at least two cylinders offset from one another;

wherein the plurality of primary outlets and the plurality of secondary outlets are fluidically connected to an outlet chamber disposed within the housing, and the outlet chamber is fluidically connected to the exhaust;

wherein each primary outlet of the plurality of primary outlets opens into an associated primary outlet channel of a plurality of primary outlet channels, and the plurality of primary outlet channels open into the outlet chamber; and wherein each secondary outlet of the plurality of secondary outlets is fluidically connected to an associated secondary outlet channel of a plurality of secondary outlet channels that are separate from the plurality of primary outlet channels, and the plurality of secondary outlet channels fluidically communicate with i) the guide via a guide outlet and ii) the outlet chamber.

18. The axial piston machine according to claim 17, wherein:

the outer opening of adjacent cylinders of the at least two cylinders are offset axially from one another with respect to a longitudinal axis of the shaft; and the at least one actuator includes a plurality of freeing sections, each freeing section of the plurality of freeing sections is configured to open an associated outer opening, and the plurality of freeing sections are offset axially to correspond with the outer openings.

19. The axial piston machine according to claim 17, wherein:

each cylinder of the at least two cylinders is radially delimited by the associated cylinder wall; and the associated cylinder wall of at least one cylinder of the at least two cylinders includes at least two primary outlets of the plurality of primary outlets.

20. The axial piston machine according to claim 17, where at least two secondary outlets of the plurality of secondary outlets communicate fluidically with the outlet chamber via a common secondary outlet channel.

* * * * *